US006382812B1

(12) United States Patent
Hsu

(10) Patent No.: US 6,382,812 B1
(45) Date of Patent: May 7, 2002

(54) DECORATIVE LIGHT STRING

(76) Inventor: Min Hsun Hsu, No. 3, Lane 49, Hsao-Nien St., Hsin-Chu City (TW)

( * ) Notice: Subject to any disclaimer, the term of this patent is extended or adjusted under 35 U.S.C. 154(b) by 0 days.

(21) Appl. No.: 09/781,432

(22) Filed: Feb. 13, 2001

(51) Int. Cl.[7] ..... F21V 21/00

(52) U.S. Cl. ..... 362/249; 362/226; 362/391; 362/377; 362/806; 439/611; 439/617; 439/699.1

(58) Field of Search ..... 362/226, 391, 362/377, 378, 806; 439/611, 617, 699.1, 699.2

(56) References Cited

U.S. PATENT DOCUMENTS 6,238,062 B1 * 5/2001 Hsu ..... 362/267

* cited by examiner

*Primary Examiner*—Sandra O'Shea
*Assistant Examiner*—Ali Alavi
(74) *Attorney, Agent, or Firm*—Rosenberg, Klein & Lee

(57) ABSTRACT

A decorative light s string is disclosed, including a power cord, a plurality of electric connectors respectively installed in the power cord, a plurality of lamp assemblies respectively connected to the electric connectors to obtain the necessary working voltage, and a plurality of electric extension wires respectively connected between the electric connectors and the lamp assemblies to transmit electricity from the power connectors and the lamp assemblies.

3 Claims, 4 Drawing Sheets

DECORATIVE LIGHT STRING

BACKGROUND OF THE INVENTION

The present invention relates to a decorative light string and, more particularly, to such a decorative light string, which comprises a plurality of electric extension wires respectively connected to a respective electric connector at a power cord, and a plurality of lamp assemblies respectively suspended from the electric extension wires.

A variety of decorative light strings and lamp sets have been disclosed, and have appeared on the market. When buying a decorative light string or lamp set, consumers usually consider the factors of waterproof arrangement, safety use, and low cost. U.S. application Ser. No. #09/453,436 discloses a modified lamp series. This structure of modified lamp series is functional, however it is less attractive because it is simply a single series of lamp set.

SUMMARY OF THE INVENTION

It is one object of the present invention to provide a decorative light string, which causes a sense of beauty when installed. It is another object of the present invention to provide a decorative light string, which has multiple lamp assemblies suspended from a power cord. According to one aspect of the present invention, the decorative light string comprises a power cord, a plurality of electric connectors respectively installed in the power cord, a plurality of lamp assemblies respectively connected to the electric connectors to obtain the necessary working voltage, and a plurality of electric extension wires respectively connected between the electric connectors and the lamp assemblies to transmit electricity from the power cord to the lamp assemblies. According to another aspect of the present invention, each electric connector is comprised of a hollow base fastened to the power cord, two metal contact plates mounted in the hollow base and respectively connected to the positive and negative poles of the power cord, a flexible insert fastened to one end of the respective electric extension wire and press-fitted into the hollow base to hold the positive and negative conductors of the respective electric extension wire in contact with the metal contact plates respectively, and a screw cap fastened to the hollow base to hold down the flexible insert in the hollow base.

PIG. 3 shows an application example of the present invention.

Figure 4:
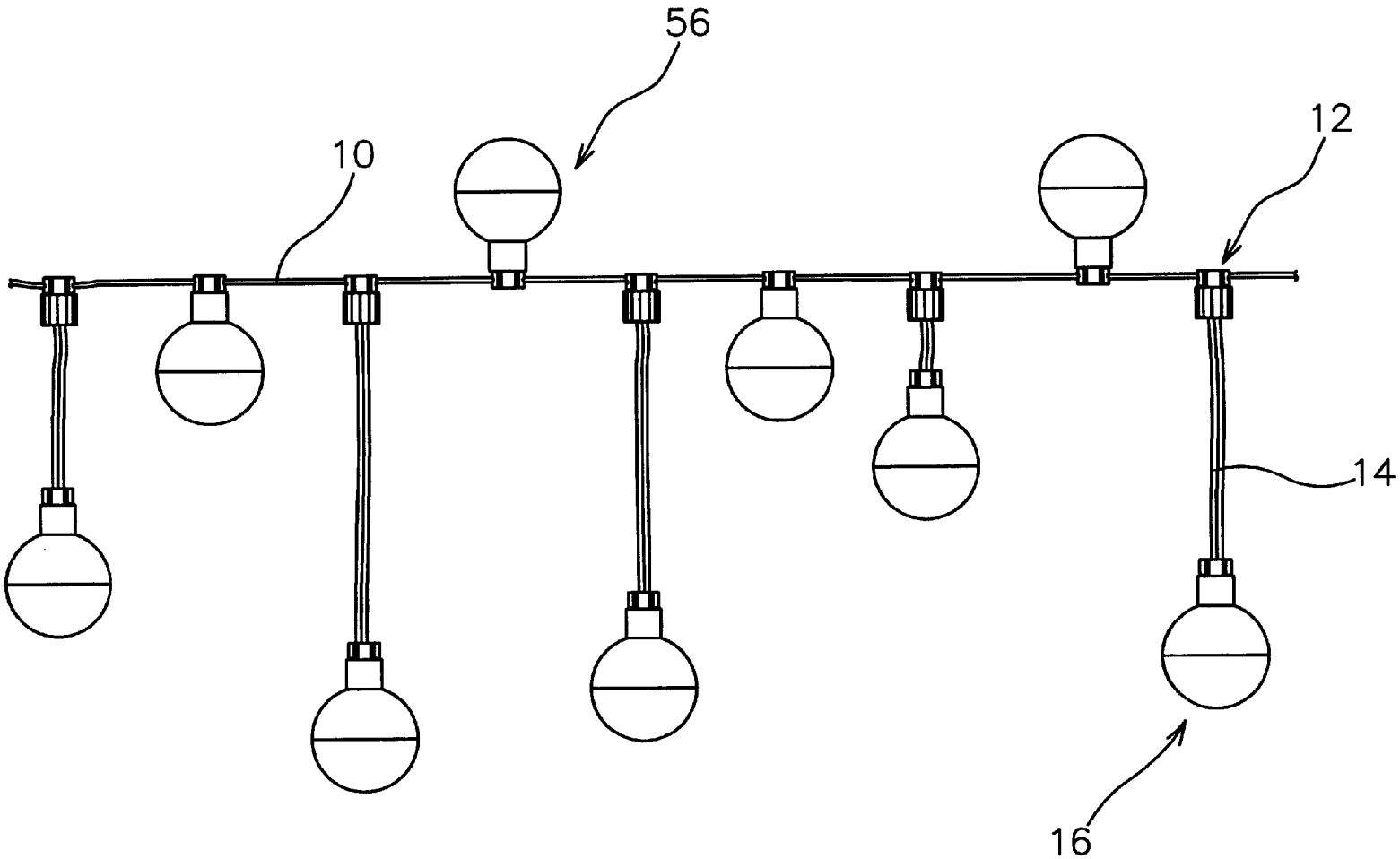

FIG. 4 shows another application example of the present invention.

DETAILED DESCRIPTION OF THE PREFERRED EMBODIMENT

Figure 1:
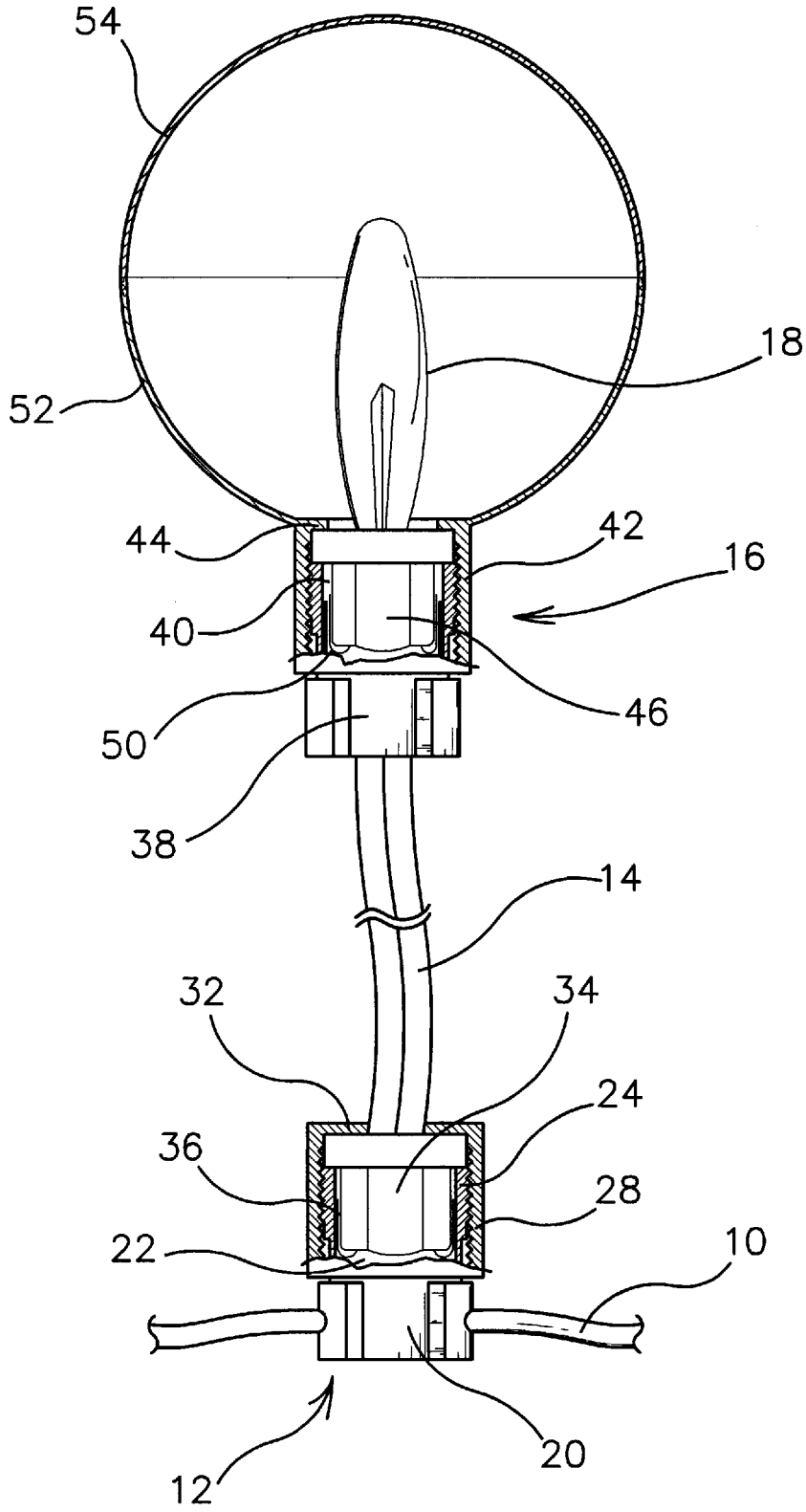
FIG. 1 is a sectional view of the present invention.
Figure 2:
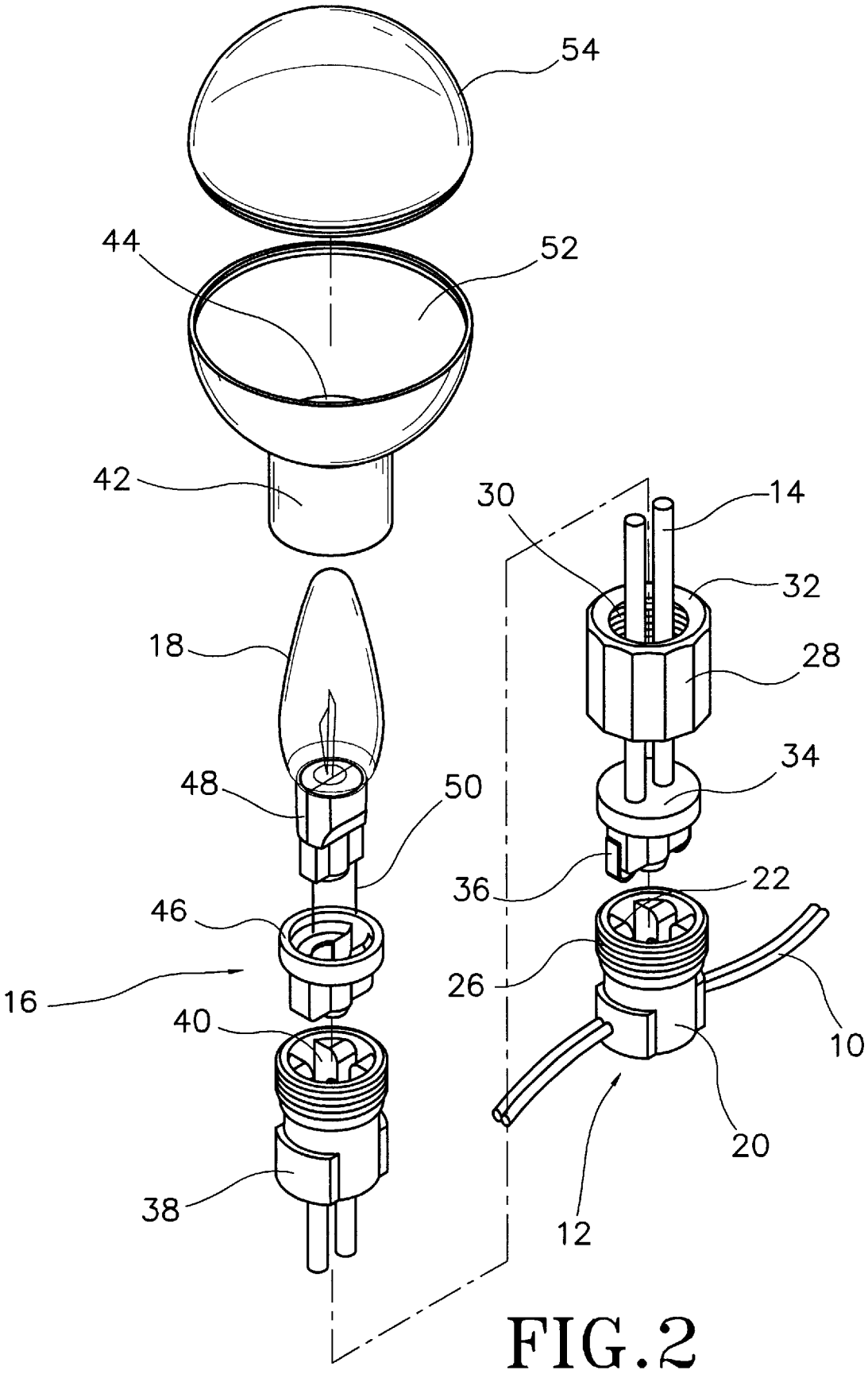
FIG. 2 is an exploded perspective view of the present invention.

Referring to FIGS. 1 and 2, a decorative light string in accordance with the present invention is generally comprised of a power cord 10, and a plurality of electric connectors 12 respectively installed in the power cord 10. An electric extension wire 14 is respectively connected to each electric connector 12 to hold a respective lamp assembly 16. Each electric connector 12 comprises a base 20 fastened to the power cord 10, the base 20 having a receiving chamber 22 and an outer thread 26, and metal contact plates 24 mounted in the receiving chamber 22 an respectively connected to the positive and negative poles of the power cord 10, a flexible insert 34 press-fitted into the receiving chamber 22 of the base 20, and a screw cap 28 fastened to the base 20 to hold down the flexible insert 34. The flexible insert 34 is made of electrically insulative material, for example, plastics. The screw cap 28 comprises an inner thread 30 threaded onto the outer thread 26 of the base 20, and a through hole 32 at the center of the top thereof for the passing of the electric extension wire 14. The electric extension wire 14 has its one end inserted through the through hole 32 of the screw cap 28 and fastened to the flexible insert 34. The positive and negative conductors 36 of the electric extension wire 14 are separated from each other and turned in reversed directions at the bottom side of the flexible insert 34. After connection of the screw cap 28 to the base 20, the positive and negative conductors 36 of the electric extension wire 14 are respectively positively maintained in contact with the metal contact plates 24 in the receiving chamber 22 of the base 20. The other end of the electric extension wire 14 is connected to the lamp assembly 16. The lamp assembly 16 comprises a lamp holder 38, the lamp holder 38 defining a receiving chamber 40, a flexible plastic insert 46 press-fitted into the receiving chamber 40, receptacle 48 fastened to the flexible plastic insert 46, the receptacle 48 having two lead-out legs 50 respectively inserted through a respective through hole (not shown) of the flexible plastic insert 46 and kept in contact with the positive and negative conductors of the electric extension wire 14 respectively, a cap 42 fastened to the lamp holder 38 by a screw joint to hold down the flexible plastic insert 46 and the receptacle 48 in the lamp holder 38, the cap 42 having a through hole 44 at the center of the top thereof, a bulb 18 mounted in the through hole 44 of the cap 42 and threaded into the receptacle 48, and a spherical lampshade fastened to the cap 42 around the bulb 18. The lampshade is comprised of a lower semispherical shell 52 integral with the cap 42, and an upper semispherical shell 54 fastened to the lower semispherical shell 52 by a screw joint. When assembled, the spherical lampshade 52;54 and the cap 42 protect the bulb 18 against outside rainwater. The lower semispherical shell 5 and the upper semispherical shell 54 admit light, and can be made having same color. Alternatively, the lower semispherical shell 52 and the upper semispherical shell 54 can have different colors. According to the present preferred embodiment, the lampshade has a spherical shape. Alternatively, the lampshade of the lower semispherical shell 52 and the upper semispherical shell 54 can be made having any of a variety of shapes, for example, a star-like shape, a rhombic shape, a polygonal shape, etc.

Figure 3:
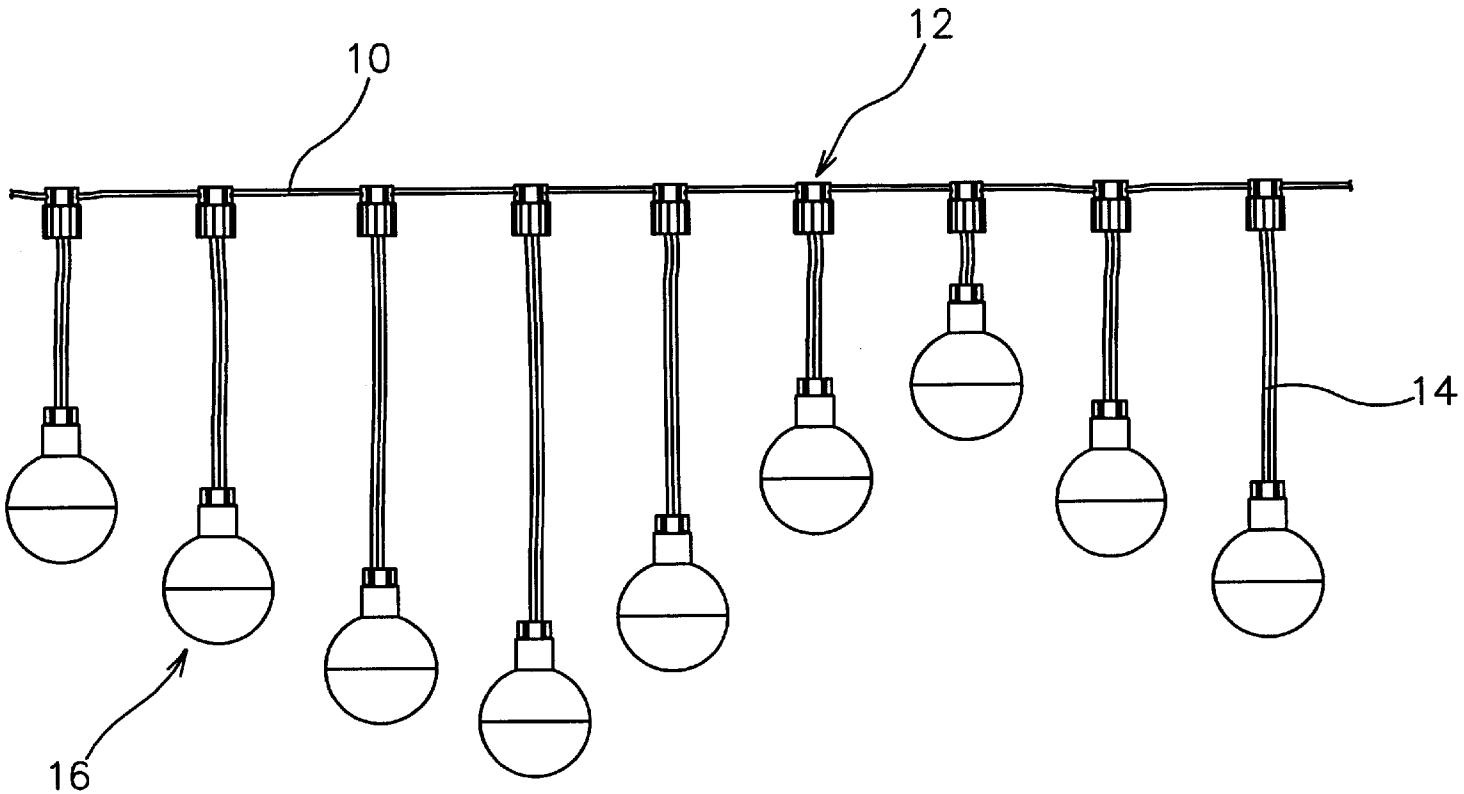

In one application example of the present invention shown in FIG. 3, the electric extension wires 14 of the decorative light string have different lengths and are respectively downwardly extended from the respective electric connectors 12 at the horizontally extended power cord 10, and the lamp assemblies 16 of the decorative light string are respectively suspended from the vertically extended electric extension wires 14 at different elevations.

In another application example of the present invention shown in FIG. 4, a plurality of electric extension wires 14 of different lengths are respectively suspended from the electric connectors 12 at the horizontally extended power cord 10 to hold a respective lamp assembly 16, and lamps 56 respectively connected in parallel to the power cord 10 at two sides of each electric connectors 12.

It is to be understood that the drawings are designed for purposes of illustration only, and are not intended for use as a definition of the limits and scope of the invention, disclosed.

What the invention claimed is:

1. A decorative light string comprising:

a power cord;

a plurality of electric connectors respectively installed in said power cord, said electric connectors each comprising a base fastened to said power cord, said base having a receiving chamber and an outer thread, and two metal contact plates mounted in said receiving chamber an respectively connected to positive and negative poles of said power cord, a flexible insert press-fitted into said receiving chamber of said base, and a screw cap fastened to said base to hold down said flexible insert, said screw cap comprising an inner thread threaded onto the outer thread of said base, and a through hole at the center of a top thereof;

a plurality of lamp assemblies respectively connected to said electric connector, said lamp assemblies each comprising a lamp holder, said lamp holder defining a receiving chamber, a flexible insert press-fitted into the receiving chamber of said lamp holder, receptacle fastened to the flexible insert in the receiving chamber of said lamp holder, said receptacle having two lead-out legs respectively fastened to the flexible insert in the receiving chamber of said lamp holder, a cap fastened to said lamp holder to hold down the flexible insert and receptacle of the respective lamp assembly, the cap of each of said lamp assemblies having a top and a through hole at the center of the top, and a bulb mounted in the through hole of the cap of the respective lamp assembly and threaded into said receptacle; and a plurality of electric extension wire respectively connected between said electric connectors and said lamp assemblies for enabling electricity to be transmitted from said power cord to said lamp assemblies, said electric extension wires each having a positive conductor and a negative conductor respectively fastened to the flexible inserts of said electric connectors and the flexible inserts of said lamp assemblies and electrically connected between the metal contact plates of said electric connectors and the lead-out legs of said lamp assemblies.

2. The decorative light string of claim 1, wherein the flexible inserts of said electric connectors and the flexible inserts of said lamp assemblies.

3. The decorative light string of claim 1, wherein said lamp assemblies each further comprise a lampshade fastened to the respective cap and covered around the respective bulb, said lampshade comprising a lower half shell fixedly mounted on the respective cap, and an upper half shell covered on said lower half shell.

* * * * *